US007077709B1

(12) United States Patent
Shin-Ting

(10) Patent No.: US 7,077,709 B1
(45) Date of Patent: Jul. 18, 2006

(54) BATTERY CONNECTOR

(75) Inventor: Yeh Shin-Ting, Shulin (TW)

(73) Assignee: L & K Precision Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 11/156,772

(22) Filed: Jun. 21, 2005

(51) Int. Cl.
*H01R 13/24* (2006.01)

(52) U.S. Cl. ..... 439/700; 439/289

(58) Field of Classification Search ..... 439/289, 439/500, 700, 824
See application file for complete search history.

(56) References Cited

U.S. PATENT DOCUMENTS 6,814,626 B1 * 11/2004 Wen-Yao ..... 439/700
6,923,690 B1 * 8/2005 Wang ..... 439/824
2005/0042938 A1 * 2/2005 Zheng et al. ..... 439/824
2005/0070171 A1 * 3/2005 Zheng et al. ..... 439/700
2005/0101195 A1 * 5/2005 Zhu et al. ..... 439/700

* cited by examiner

*Primary Examiner*—Thanh-Tam Le
(74) *Attorney, Agent, or Firm*—Troxell Law Office, PLLC

(57) ABSTRACT

A battery connector has contact elements and an insulative housing. The insulative housing defines channels and assembling grooves nearby the channels. Guiding elements are movably mounted in the channels for guiding the contact elements. Soldering elements are assembled on the assembling grooves. The contact elements include engaging ends and contact ends. The engaging ends are fixed on the guiding elements near the mating surface, and the contact ends have portions extending beyond the channels from the mating surface. The soldering elements at least have abutting portions contacting the contact ends of the contact elements all along. Spring elements are assembled to the guiding elements for providing the guiding elements with return force. Correspondingly, the overall height of the battery connector reduces, thereby meeting the tendency of miniature.

10 Claims, 4 Drawing Sheets

BATTERY CONNECTOR

BACKGROUND OF THE INVENTION

1. Field of the Invention

The present invention relates to a battery connector, and particularly to a battery connector with low profile and minimal size, which engages to mating terminals reliably for ensuring stable transmission and charging.

2. Related Art

Portable electronic products, such as mobile phones, Personal Digital Assistant (PDA), Notebook and digital camera, are commonly used without limitation of prescribed place. These electronic products always consume power, and therefore charging is critical. Charging devices are ordinarily utilized in these products for supplying power. Battery connectors correspondingly serve as media between the electronic products and power. A battery connector comprises an insulative housing, a plurality of conductive terminals assembled on the insulative housing and soldered to a circuit board. Each conductive terminal includes a contact portion for contacting a charging terminal of the electronic products, and a soldering portion for soldering to the circuit board.

In prior art, the conductive terminals are often integrally formed. The soldering portions are bent for soldering to the circuit board, and the contact portions are suspended for possessing flexibility. However, the contact portions have to be bent at a fixed bending angle in that restraint of material and shaping conditions. The fixed bending angle limits height of contact portions, and therefore limits overall height of the battery connector. The contact portions of the conductive terminals of prior art can not become lower, depressing the miniature tendency.

SUMMARY OF THE INVENTION

Accordingly, an object of the present invention is to provide a battery connector which meeting miniature tendency, wherein contact elements thereof are not subject to shaping conditions, contact ends of the contact elements have desirable resiliency and low profile, and the overall height of the battery connector relatively decreases.

The battery connector comprises contact elements, and an insulative housing defining channels and assembling grooves nearby the channels. Guiding elements are movably mounted in the channels for guiding the contact elements. Soldering elements are assembled on the assembling grooves. The soldering elements at least have abutting portions contacting the contact elements all along. Spring elements are assembled to the guiding elements for providing the guiding elements with return force. Before charging, the contact elements are pushed rearward and are guided by the guiding elements to press the spring elements. The spring elements correspondingly produce energy and assure the contact elements engaging with charging terminals firmly. After charging, the contact elements are released, and the spring elements return to a normal state.

DESCRIPTION OF THE PREFERRED EMBODIMENTS

Figure 1:
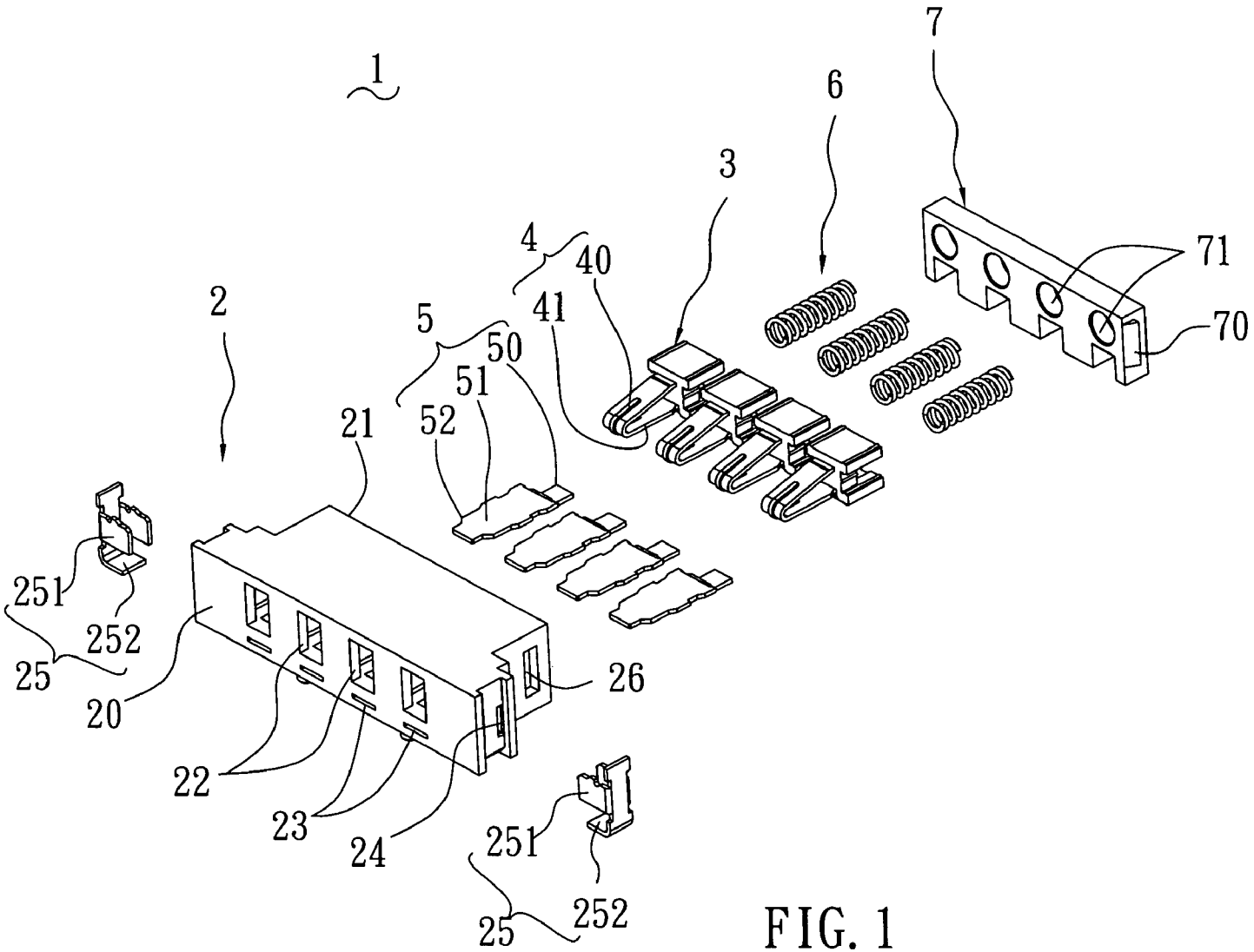
FIG. 1 is an exploded view of a battery connector according to the present invention.

With reference to FIG. 1, a battery connector 1 in accordance with the present invention comprises an insulative housing 2, guiding elements 3, contact elements 4, soldering elements 5, spring elements 6 and a cover 7, which are separately formed. The insulative housing 2 has a mating surface 20 and a soldering surface 21 opposite to each other. Four rectangular channels are defined through the mating surface 20 and the soldering surface 21 for mounting the guiding elements 3 therein. Assembling grooves 23 are respectively defined below the channels 22 and horizontally shaped for mounting the soldering elements 5. Embedding grooves 24 are respectively defined in both sides of the insulative housing 2 and adjacent to the mating surface 20 for mounting positioning sheets 25 therein. The positioning sheets 25 include assembling arms 251 for interferentially fitting within the embedding grooves 24, and soldering arms 252 bent for surface mounting. Locking grooves 26 are defined in both sides of the insulative housing 2 and adjacent to the soldering surface 21 for engaging with the cover 7.

The cover 7 are assembled adjacent to the soldering surface 21 of the insulative housing 2, and forms tabs 70 on opposite sides thereof for locking the locking grooves 26. First positioning grooves 71 are defined in a front surface of the cover 7 and face the soldering surface 21 for positioning ends of the spring elements 6.

The guiding elements 3 are rectangular and are movably mounted in the channels 22 for guiding the contact elements 4. Second positioning grooves 30 are defined in a rear surface of the guiding elements 3 (shown in FIG. 4) and face the soldering surface 21 for positioning another ends of the spring elements 6.

Figure 4:
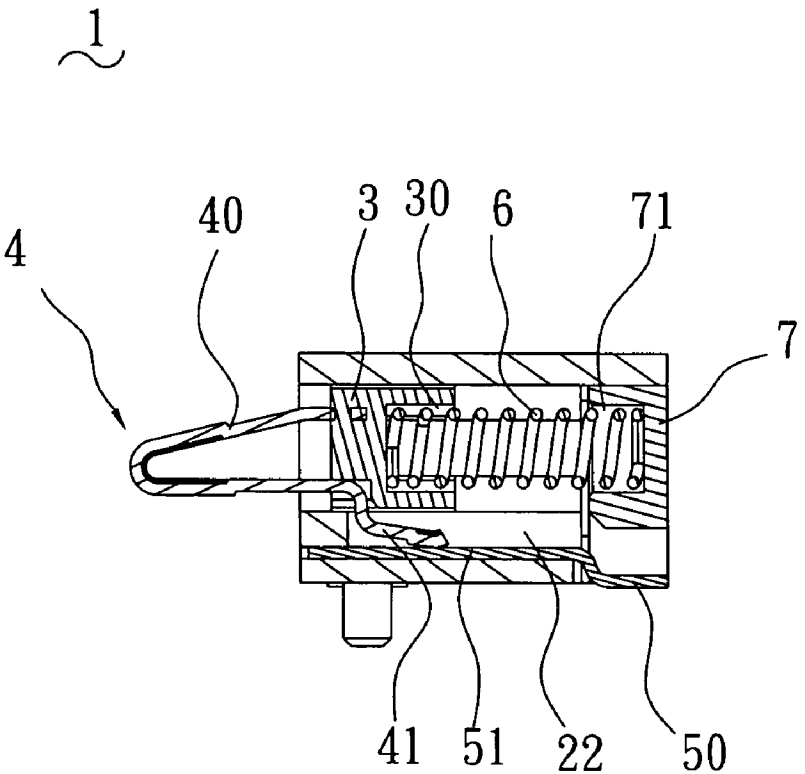
FIG. 4 is a cross-sectional view of the battery connector which is transversely cut off for showing state thereof before charging.

Each contact element 4 includes an engaging end 40 and a contact end 41, which are integrally formed of a common metal sheet and bent therefrom. The engaging ends 40 are fixed on the guiding elements 3 and near the mating surface 20. The contact ends 41 have portions extending beyond the channels 22 from the mating surface 20, as shown in FIG. 4. The contact ends 41 are bent appropriately for surface mounting.

Each soldering element 5 is stamped from a separate metal sheet and is assembled on an assembling groove 23 of the insulative housing 2. Each soldering element 5 includes a soldering portion 50 and a flat abutting portion 51 at opposing ends thereof. The soldering portion 50 is bent appropriately for surface mounting. Barbs 52 are respectively formed on opposite sides of the abutting portion 51 for interferentially mounting on the assembling grooves 23. The abutting portions 51 contact the contact ends 41 of the contact elements 4 all along, as shown in FIGS. 4 and 5.

The spring elements 6 are compressed spring and are assembled between the guiding elements 3 and the cover 7, where ends of the spring elements 6 are mounted on the first positioning grooves 71 and another ends of the spring elements 6 are mounted on the second positioning grooves 30, respectively. Thus the guiding elements 3 possess return force when the spring elements 6 preserve energy.

Figure 2:
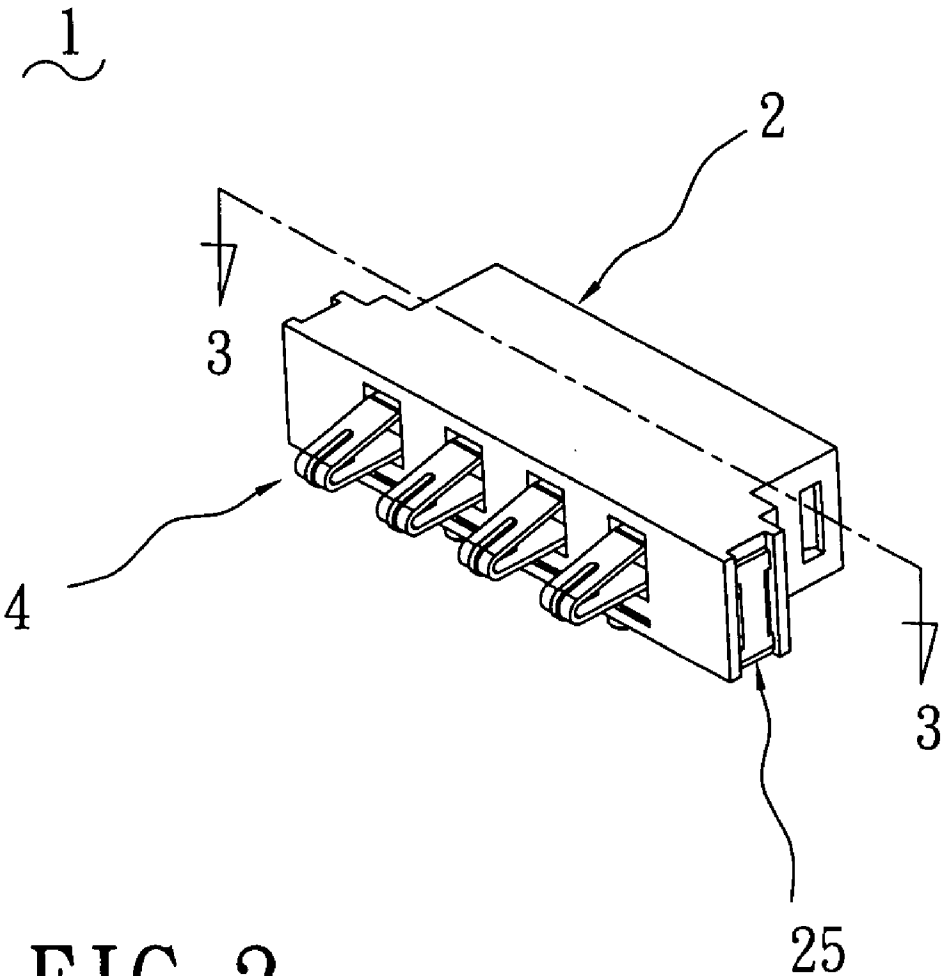
FIG. 2 is an assembled view of the battery connector of FIG. 1.

In assembly, the contact elements 4 are firstly fixed on the guiding elements 3, and are assembled with the guiding elements 3 together onto the channels 22. The barbs 52 of the soldering elements 5 are fitted into the assembling grooves 23. The spring elements 6 are assembled between the guiding elements 3 and the cover 7, opposite ends thereof being mounted on the first positioning grooves 71 and the second positioning grooves 30 respectively. The assembling arms 251 of the positioning sheets 25 are interferentially assembled on the embedding grooves 24, as shown in FIG. 2.

Figure 3:
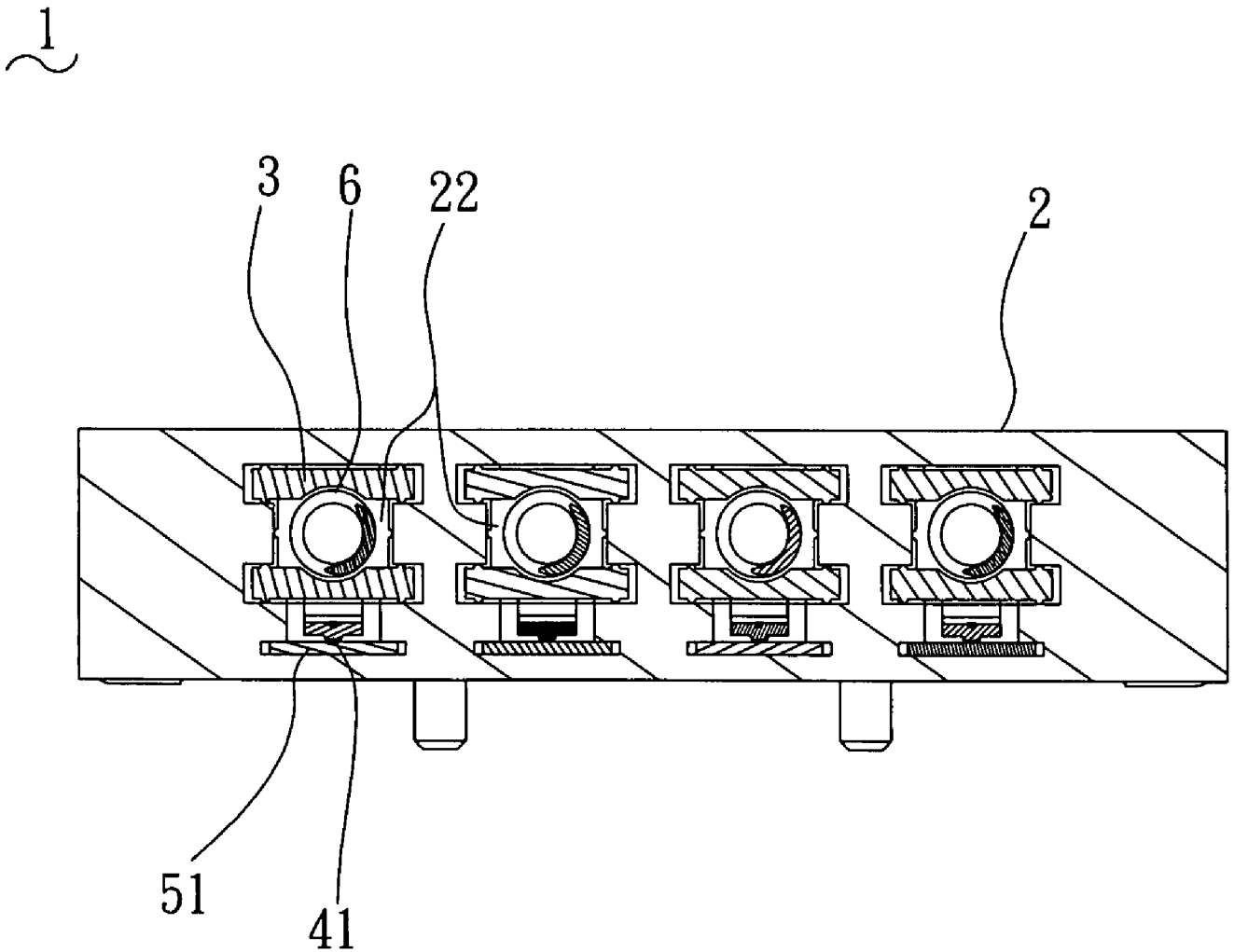
FIG. 3 is a cross-sectional view taken along the line 3—3 of FIG. 2.
Figure 5:
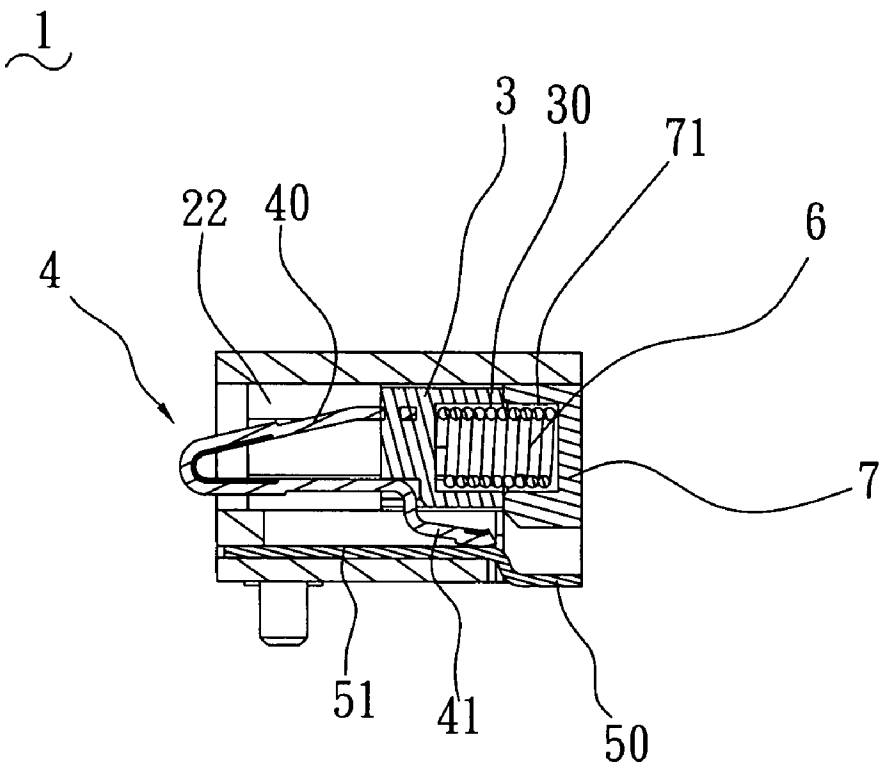
FIG. 5 is a cross-sectional view of the battery connector which is transversely cut off for showing state thereof during charging.

Further referring to FIGS. 3 through 5, when the battery connector 1 is used, the contact elements 4 are pushed rearward and move along the channels 2 with the guidance of the guiding elements 3. Correspondingly the spring elements 6 preserve energy, as shown in FIG. 5. Meanwhile the abutting portions 51 contact the contact ends 41 of the contact elements 4 all along. The spring elements 6 press charging terminals (not shown) 7 to mate with the contact ends 41 firmly. After charging, the charging terminals are removed, and the contact elements 4 are released. Then the spring elements 6 return to normal position, as shown in FIG. 4. As clearly shown in FIGS. 4 and 5, the abutting portions 51 of the soldering elements 5 remain to engage with the contact ends 41 of the contact elements 4. The spring elements 6 assure the reliable engagement between the contact ends 41 and the charging terminals. The contact elements 4 are bent at relatively small angle without consideration of flexibility, thereby reducing the overall height of the battery connector 1.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A battery connector comprising:

an insulative housing having a mating surface and a soldering surface, channels being defined through the mating surface and the soldering surface, assembling grooves being respectively defined nearby the channels;

guiding elements movably mounted in the channels;

contact elements including engaging ends and contact ends, the engaging ends being fixed on the guiding elements and near the mating surface, the contact ends having portions extending beyond the channels from the mating surface;

soldering elements assembled on the assembling grooves, and including soldering portions and abutting portions, the abutting portions contacting the contact ends of the contact elements all along; and spring elements assembled to the guiding elements and adjacent to the soldering surface for providing the guiding elements with return force.

2. The battery connector as claimed in claim 1, wherein the engaging ends and the contact ends of the contact elements are integrally formed of a common metal sheet and are bent therefrom.

3. The battery connector as claimed in claim 1, wherein the soldering elements are stamped from a metal sheet, and wherein the soldering portions are bent appropriately for surface mounting, and the abutting portions are flat and form the barbs on opposite sides thereof for interferentially mounting on the assembling grooves.

4. The battery connector as claimed in claim 1, further comprises a cover mounted adjacent to the soldering surface, wherein the cover forms tabs thereon, and the insulative housing defines locking grooves for engaging with the tabs of the cover.

5. The battery connector as claimed in claim 4, wherein the cover defines first positioning grooves facing the soldering surface, and the guiding elements define second positioning grooves facing the soldering surface, and wherein opposite ends of the spring elements are respectively mounted on the first positioning grooves and the second positioning grooves.

6. The battery connector as claimed in claim 1, wherein the spring elements are compressed spring.

7. The battery connector as claimed in claim 1, wherein the channels of the insulative housing are rectangular, and the guiding elements are rectangular.

8. The battery connector as claimed in claim 1, wherein the assembling grooves are horizontally shaped for mounting the soldering elements thereon.

9. The battery connector as claimed in claim 1, wherein embedding grooves are respectively defined in both sides of the insulative housing and adjacent to the mating surface for mounting positioning sheets therein, the positioning sheets including assembling arms and soldering arms.

10. The battery connector as claimed in claim 9, wherein the contact ends of the contact elements and the soldering arms of the positioning sheets and bent appropriately for surface mounting.

* * * * *